US005550421A

United States Patent [19]

Scholz et al.

[11] Patent Number: 5,550,421

[45] Date of Patent: Aug. 27, 1996

[54] DISCHARGE LAMP WITH ENHANCED PERFORMANCE AND IMPROVED CONTAINMENT

[75] Inventors: John A. Scholz, Georgetown, Mass.; Sandra M. Morin, Manchester, N.H.

[73] Assignee: Osram Sylvania Inc., Danvers, Mass.

[21] Appl. No.: 349,852

[22] Filed: Dec. 6, 1994

[51] Int. Cl.[6] ..... H01J 61/34; H01J 61/18

[52] U.S. Cl. ..... 313/25; 313/634; 313/635; 313/573

[58] Field of Search ..... 313/25, 634, 635, 313/636, 638, 573

[56] References Cited

U.S. PATENT DOCUMENTS

| | | | |
|---|---|---|---|
| 4,170,746 | 10/1979 | Daveport et al. | 315/246 |
| 4,281,274 | 7/1981 | Bechard et al. | 315/49 |
| 4,499,396 | 2/1985 | Fohl et al. | 313/25 |
| 4,709,184 | 11/1987 | Keeffe et al. | 313/638 |
| 4,888,517 | 12/1989 | Keeffe et al. | 313/25 |

*Primary Examiner*—Nimeshkumar D. Patel
*Attorney, Agent, or Firm*—William H. McNeill

[57] ABSTRACT

A metal halide arc discharge lamp comprising: an arc tube containing an arc generating and sustaining medium and having first and second electrodes sealed at opposite ends thereof; an outer envelope surrounding said arc tube and having first and second terminals for electrical connection thereto; an electrical connector coupling said first electrode to said first terminal; an electrical connector coupling said second electrode to said second terminal; a heat reflecting coating on at least one end of said arc tube; a starting aid operatively associated with said arc tube; and a light transmissive shroud positioned about said arc tube on at least two sides thereof; said arc tube having a given wall thickness of about 0.5 mm and said shroud having a thickness greater than said given thickness, the ratio of said shroud wall thickness to said arc tube wall thickness being about 2. The lamp has an increased CRI over lamps made with thicker-walled arc tubes and the thinner arc tube material allows the use of 1 mm thick shrouds which still provide containment in the event of an arc tube burst.

4 Claims, 3 Drawing Sheets

DISCHARGE LAMP WITH ENHANCED PERFORMANCE AND IMPROVED CONTAINMENT

TECHNICAL FIELD

This invention relates to arc discharge lamps and more particularly to such lamps having enhanced performance and improved containment in the unlikely event of a capsule burst.

BACKGROUND ART

Arc discharge lamps, particularly of the metal halide variety, are frequently employed in commercial usage because of their high luminous efficacy and long life. A typical metal halide lamp includes a quartz or fused silica arc tube that is hermetically sealed within a borosilicate glass outer envelope. The arc tube, itself hermetically sealed, has tungsten electrodes sealed into opposite ends and contains an arc generating and sustaining medium. This medium, or fill, includes mercury, metal halide additives which generally include the halides of sodium, cesium and scandium, and a rare gas to facilitate starting. Starting aids, in the form of auxiliary electrodes, as is well known in the art, or ultraviolet sources, as shown in U.S. Pat. Nos. 4,818, 915 and 5,323,091, can also be used. In high wattage lamps the outer envelope is filled with nitrogen or other inert gas at less than atmospheric pressure. In low wattage lamps, such as those operated at about 100 watts, the outer envelope is evacuated and provided with gettering material to maintain the vacuum.

These lamps, as they age, develop less lumens, show an increase in voltage and a lowering of their color rendering index (CRI).

Further, it has been found desirable to provide these metal halide arc discharge lamps with a shroud which comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends; however, in other cases, the shroud is open on one end and has a closed, domed configuration at the other end. Shrouds for metal halide arc discharge lamps are disclosed in U.S. Pat. Nos. 4,499,396; 4,580,989; and 4,281,274, as well as the above-mentioned 5,323,091.

The quartz shrouds employed by the prior art lamps are expensive because of their size as characterized by their wall thickness which is 3 mm, this size having been determined to be necessary because of the mass of the arc tubes which are constructed from quartz having a wall thickness of 1 mm.

Shrouds of hard glass having a lesser thickness are disclosed in co-pending application Ser. No. 08/033,525, filed Mar. 3 1993 and assigned to the assignee of the instant application.

DISCLOSURE OF THE INVENTION

It is, therefore, an object of the invention to obviate the disadvantages of the prior art.

It is another object of the invention to enhance the operation of arc discharge lamps.

Yet another object of the invention is the improvement of the containment capabilities of arc discharge lamps.

These objects are accomplished, in one aspect of the invention, by the provision of a metal halide arc discharge lamp wherein the arc tube has a given wall thickness of about 0.5 mm and a shroud surrounding the arc tube has a thickness greater than the given thickness, the ratio of the shroud wall thickness to the arc tube wall thickness being about 2.

Decreasing the thickness of the arc tube reduces the mass of any particles resulting from a burst and thereby allows for a reduction in the thickness of the shroud. Further, lamps constructed with the thin wall arc tube showed increased lumen maintenance and an enhanced color rendering index (CRI) with no effect upon color temperature.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 5:
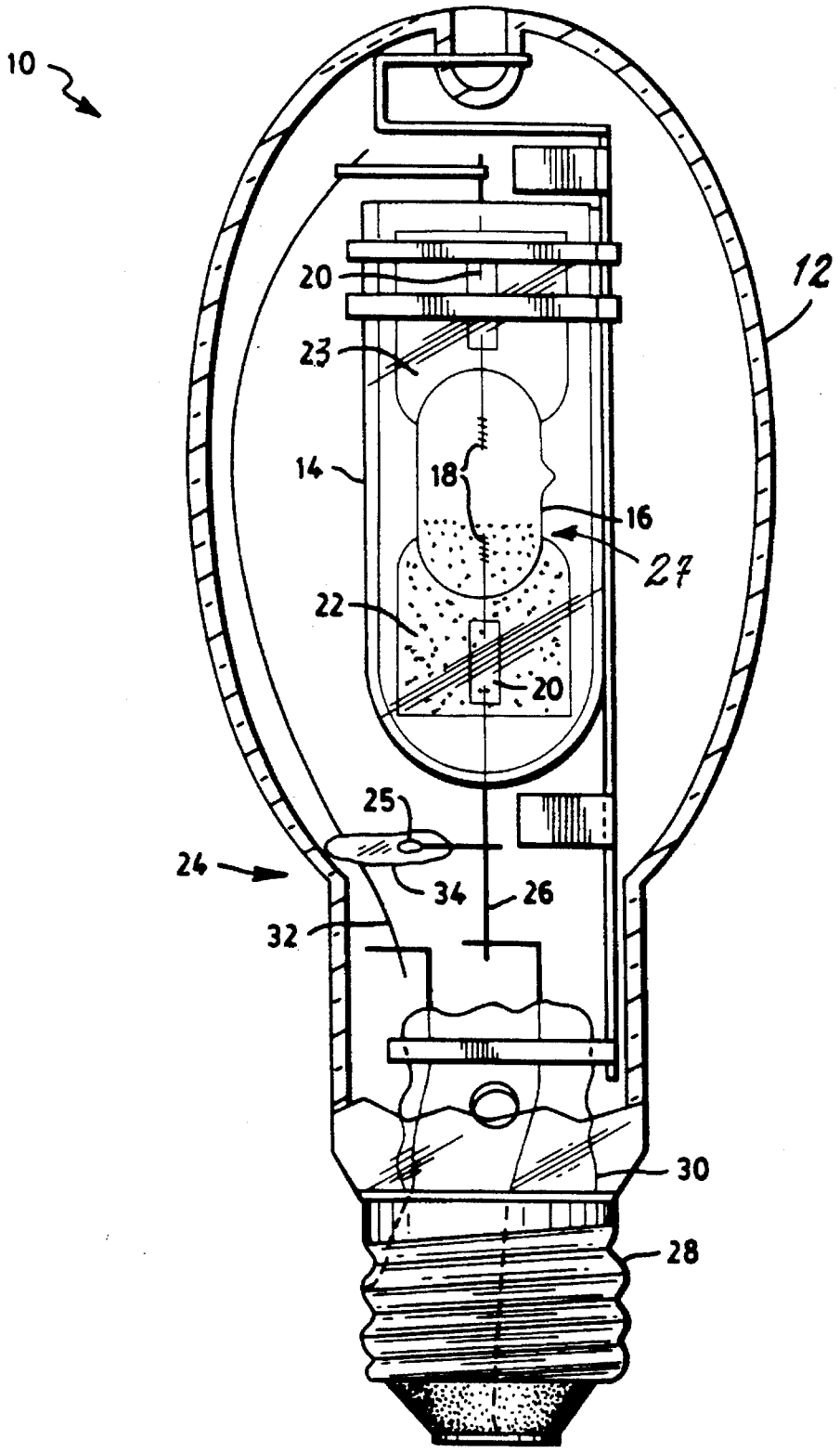
FIG. 5 is an elevational view, partly in section, of a lamp employing an embodiment of the invention.

Referring now to the drawings with greater particularity there is shown in FIG. 5 a metal halide arc discharge lamp 10 having a sealed envelope 12 enclosing a quartz sleeve 14. The sleeve 14 surrounds an arc tube 16 having electrodes 18 located at opposite ends thereof and a fill material capable of generating and sustaining an arc. The fill can comprise mercury, metal halides and argon, as is well known. In a preferred embodiment at least the halides of sodium, cesium and scandium are present. Each electrode is coupled to a moly ribbon 20 which is enclosed in a press seal 22, 23, that hermetically seals the arc tube. Electrical energy is coupled from a lamp base 28 through a lamp stem 30 and leads 32 and 26 to the electrodes 18 of the arc tube. A coating of suitable material, 27, such as zirconium dioxide, covers the ends of the arc tube to control the cold spot temperature, as is known in the art.

A UV enhancer 24 has a sealed envelope 34 that encloses an electrode 25. The electrode 25 is coupled to the lead-in wire 26 and is capacitively coupled to the lead-in wire 32, which may include a conductor that is helically wrapped around the envelope 34. A typical UV enhancer is about 4.0 mm in diameter and 15.0 to 20.0 mm in overall length. Further details of UV enhancers are disclosed in U.S. Pat. No. 5,323,091.

The shroud 14 shown in the figure has a domed configuration; however, it is to be understood that a shroud comprising a cylinder open at both ends is equally appropriate, such shrouds also being known.

The construction of the lamp of the invention is substantially as described above except that the arc tube 16 is constructed of quartz having a wall thickness of 0.5 mm and the shroud is constructed of quartz having a thickness of 1.0 mm. This results in a considerable saving of material cost, as quartz is a material sold by the pound. Referring to the illustrated graphs, it will be seen that the lamps embodying the invention (test A) compare favorably to the standard lamps (Control). Of particular importance, the graph of FIG.

Figure 1:
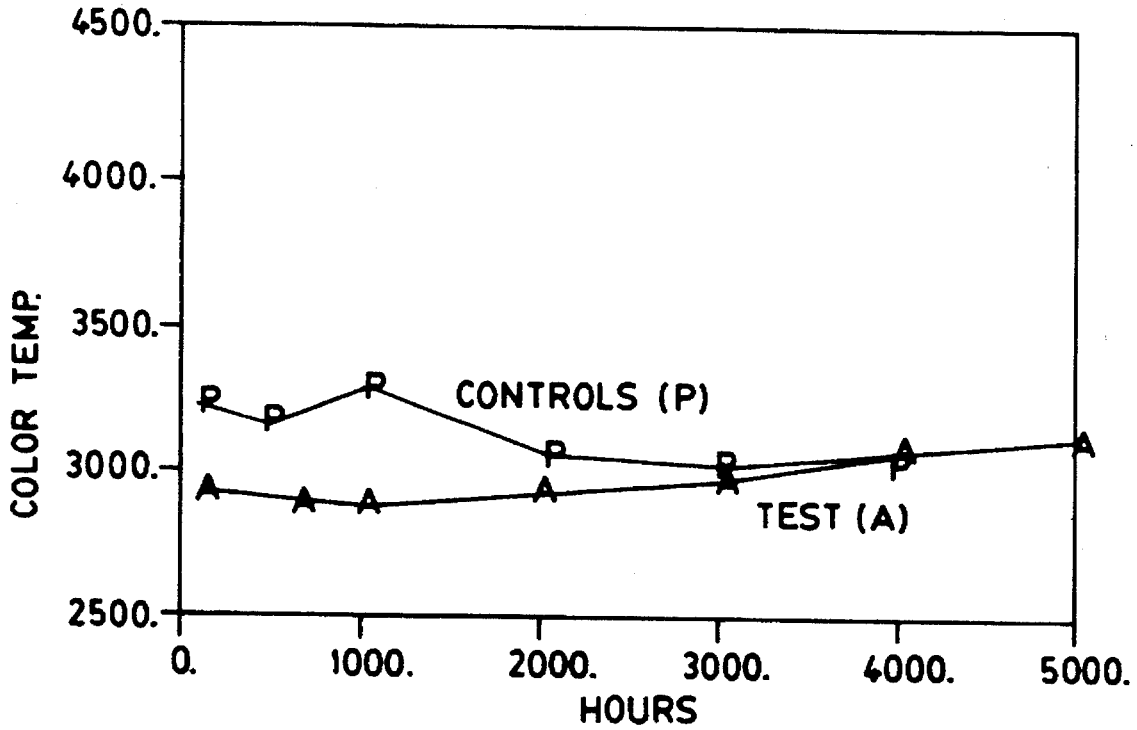
FIGS. 1–4 are graphs illustrating operating conditions for lamps embodying the invention.
Figure 2:
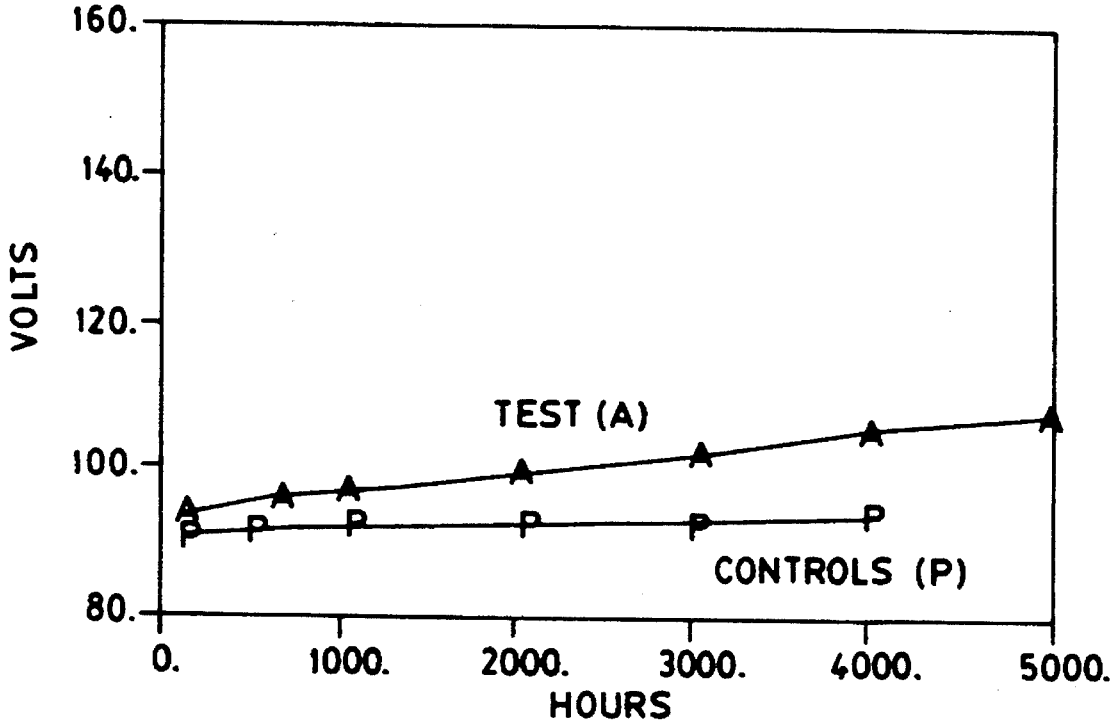
Figure 3:
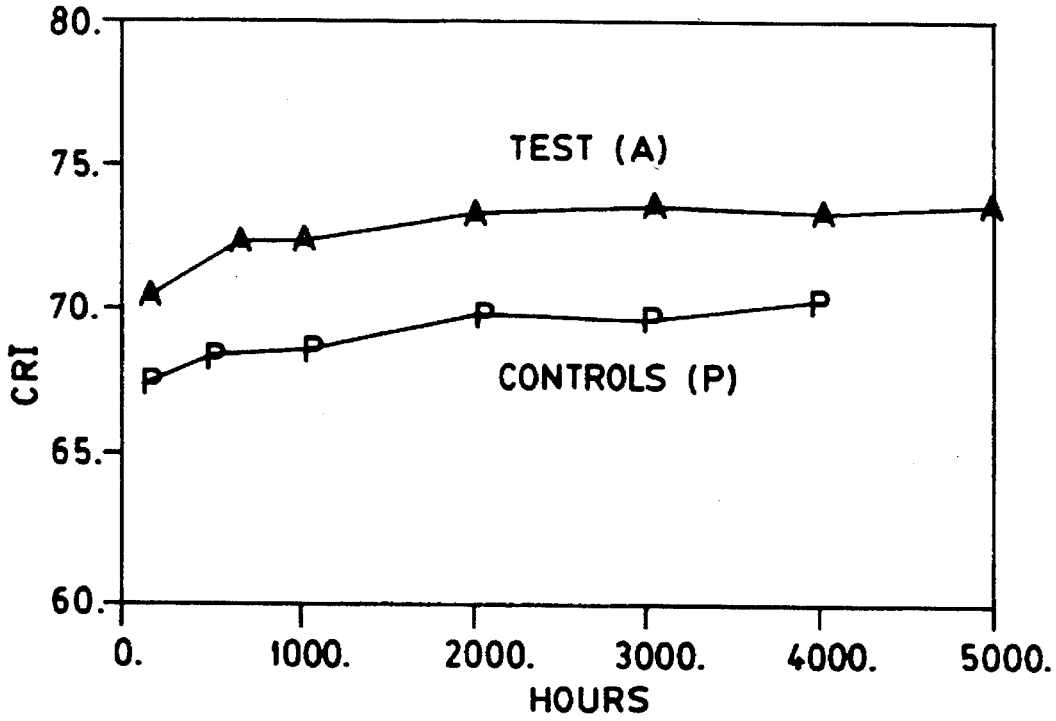
Figure 4:
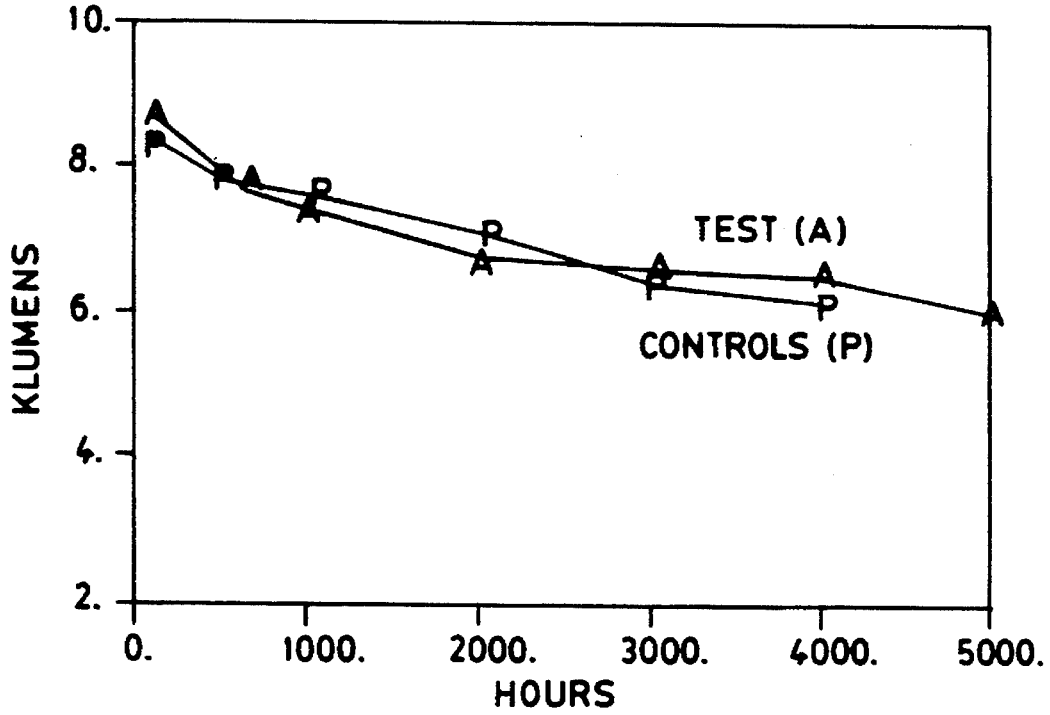

3 shows much improved CRI for the inventive lamps as well as comparable lumen loss out to 4000 hours, which is shown in FIG. 4.

These improvements are accomplished with the use of less expensive materials since the arc tube has a thickness of only 0.5 mm and the shroud a thickness of 1 mm.

The reason for the effect of the increased CRI is not known with certainty, but it is believed that it is a result of maintaining a more uniform temperature within the arc tube and, consequently, a lesser amount of heat sinking through the press seal areas owing to the thin quartz in those areas. The less heat sinking, the more heat retention. This heat retention in a region occupied by the condensate generates increased CRI without adversely affecting other operating parameters, such as color temperature. Containment of the lamps was tested by force failing. Force failing comprises starting a lamp and running to equilibrium and then discharging a 20–30 microfarad capacitor at between 1500–2500 volts connected across the lamp. When lamps having the 0.5 mm arc tube wall and the 1 mm wall thickness shroud where mounted in a standard ED-17 outer jacket were so tested all of the arc tubes failed violently; however, all of the outer jackets remained intact and contained all fragments.

The use of the arc tube and shroud of this invention increases the CRI of the lamps and provides excellent containment in the event of a burst. Further, processing times are reduced when using the thin wall material. Owing to the decreased amount of mass, the material requires less time to heat to a plastic state so as to perform the press sealing of the electrodes. Reduced press sealing time also correlates to a diminished amount of time that the electrode assemblies are exposed to the extreme heat from the sealing fires. This decreased amount of time reduces the potential of electrode oxidation which, in time, will adversely effect lamp performance and life.

While there have been shown an described what are at present considered the preferred embodiments of the invention, it will be apparent to those skilled in the art that various changes and modifications can be made herein without departing from the scope of the invention as defined by the appended claims.

What is claimed is:

1. A metal halide arc discharge lamp comprising: an arc tube containing an arc generating and sustaining medium and having first and second electrodes sealed at opposite ends thereof; an outer envelope surrounding said arc tube and having first and second terminals for electrical connection thereto; an electrical connector coupling said first electrode to said first terminal; an electrical connector coupling said second electrode to said second terminal; a heat reflecting coating on at least one end of said arc tube; a starting aid operatively associated with said arc tube; and a light transmissive shroud positioned about said arc tube on at least two sides thereof; said arc tube having a wall thickness of about 0.5 mm and said shroud having a thickness of about 1 mm, whereby the ratio of said shroud wall thickness to said arc tube wall thickness is about 2.

2. The arc discharge lamp of claim 1 wherein said shroud encloses said arc tube on three sides.

3. The arc discharge lamp of claim 1 wherein said arc tube is quartz and said shroud is quartz.

4. The arc tube of claim 1 wherein said starting aid comprises a source of ultraviolet radiation within said outer envelope proximate said arc tube.

* * * * *